US006019260A

United States Patent [19]

Gouldson

[11] Patent Number: 6,019,260

[45] Date of Patent: Feb. 1, 2000

[54] SIDE INDICATOR HANGERS AND METHOD AND APPARATUS FOR REMOVING INDICATORS FROM HANGERS

[75] Inventor: Stanley F. Gouldson, Northport, N.Y.

[73] Assignee: Spotless Plastics Pty. Ltd., Australia

[21] Appl. No.: 09/123,075

[22] Filed: Jul. 27, 1998

Related U.S. Application Data

[63] Continuation-in-part of application No. 08/908,210, Aug. 8, 1997, abandoned.

[51] Int. Cl.[7] ..... A47G 25/14

[52] U.S. Cl. ..... 223/85; 40/322

[58] Field of Search ..... 223/85, 88, 92, 223/95; D6/315; 40/322

[56] References Cited

U.S. PATENT DOCUMENTS

| | | | |
|---|---|---|---|
| 4,006,547 | 2/1977 | Samuels . | |
| 4,322,902 | 4/1982 | Lenthall . | |
| 5,096,101 | 3/1992 | Norman . | |
| 5,238,159 | 8/1993 | Zuckerman . | |
| 5,305,933 | 4/1994 | Zuckerman . | |
| 5,377,884 | 1/1995 | Zuckerman . | |
| 5,383,583 | 1/1995 | Zuckerman . | |
| 5,388,354 | 2/1995 | Marshall et al. . | |
| 5,407,109 | 4/1995 | Zuckerman . | |
| 5,441,182 | 8/1995 | Sullivan . | |
| 5,449,099 | 9/1995 | Blanchard . | |
| 5,469,995 | 11/1995 | Bredeweg et al. . | |
| 5,477,995 | 12/1995 | Dooley et al. . | |
| 5,485,943 | 1/1996 | Zuckerman . | |
| 5,503,310 | 4/1996 | Zuckerman . | |
| 5,507,086 | 4/1996 | Marshall et al. . | |
| 5,524,801 | 6/1996 | Dooley et al. . | |
| 5,586,697 | 12/1996 | Johansson | 12/85 |
| 5,590,822 | 1/1997 | Zuckerman . | |
| 5,597,100 | 1/1997 | Blitz | 223/85 |
| 5,603,437 | 2/1997 | Zuckerman . | |
| 5,611,469 | 3/1997 | Eiley et al. . | |
| 5,628,132 | 5/1997 | Marshall et al. . | |
| 5,642,840 | 7/1997 | Abdi . | |
| 5,687,887 | 11/1997 | Bond et al. . | |
| 5,915,995 | 10/1998 | Zuckerman | 223/85 |

FOREIGN PATENT DOCUMENTS

WO 94 07399 12/1997 European Pat. Off. .

*Primary Examiner*—Bibhu Mohanty
*Attorney, Agent, or Firm*—Scully, Scott, Murphy & Presser

[57] ABSTRACT

A molded plastic garment hanger having an improved indicator detachment opening is disclosed, wherein the hanger has a hook with a web adjacent said hook and a hanger body, wherein the web is received within a cavity of a molded plastic indicator having side walls. The web and the indicator combining to provide a security means to prevent unauthorized removal of the indicator. The web is formed with a detachment opening formed in the web which extends through the security means and under said indicator to allow the indicator to be removed with a detachment wedge inserted in said opening. A method and apparatus for removing the indicator from the web is also provided by inserting a reciprocal wedge mounted on a first plate into the opening defined in the web to displace the indicator and thereby release the indicator from the web without damaging either the indicator or the hanger. The present invention contemplates automated as well as manual removal of the indicator from the hanger and provides a method and device therefor.

9 Claims, 3 Drawing Sheets

SIDE INDICATOR HANGERS AND METHOD AND APPARATUS FOR REMOVING INDICATORS FROM HANGERS

CROSS REFERENCE TO RELATED APPLICATIONS

This application is a continuation-in-part application of U.S. Ser. No. 08/908,210, entitled "INDICATOR DETACHMENT MECHANISM AND METHOD AND APPARATUS FOR REMOVING INDICATORS FROM HANGERS", filed Aug. 8, 1997 now abandoned.

FIELD OF THE INVENTION

This invention relates to a garment hanger having a side sizer indicator, and a method and apparatus for removing the side sizer indicator from the hanger.

BACKGROUND OF THE INVENTION

For purposes of displaying garments suspended on hangers in an orderly manner to the retail customer, certain retail stores desire to affix an indicating means on the side of the hook of the hanger where the hook meets the hanger body. The indicating means identifies some attribute of the garment suspended from the hanger, such as size, quality, color, manufacturing data, or pattern.

To accommodate the various types of hangers available in the industry, numerous indicating means have been developed in a variety of shapes, sizes and materials. Similarly, hangers have been developed to accommodate a variety of different indicating means.

U.S. Pat. No. 4,115,940 discloses a side sizer indicator for a garment hanger, having a removable indicia carrying tab. The indicia is attached to a web contiguous to the hanger body which is joined to both the body and the hook.

The small size and the removable nature of this indicia generated concern on the part of some garment hanger manufacturers that prompted the development of non-removable or child proof indicia for garment hangers.

U.S. Pat. Nos. 5,096,101 and 5,199,608 disclose garment hangers with locking or irremovable information tabs, which hangers use a rib or thickened body portion to surround the indicia and block access to the underside of the indicia.

U.S. Pat. No. 5,441,182 also discloses a garment with a locking information clip having hook like elements or a raised platform to seat the clip, each of which prevents easy removal of the clip.

Environmental concerns have also generated a desire for hangers having information indicia which are essentially unremovable for the average consumer, but removable with the appropriate tooling for reuse and recycle purposes. Inasmuch as the indicators are generally colored plastic, it is highly desirable in any recycling program to remove the indicator before grinding the hangers for reuse. Further, in a reuse program, it is necessary to remove the old size indicia before fitting a new one.

An example of a garment hanger with a child proof size indicator and a special tool for removing the indicator is illustrated in U.S. Pat. No. 5,449,099. As taught is in this patent, the hanger may be molded with cuts in the protective rib which surrounds the clip to enable manual access by a special tool. This system however does not enable automated removal of the size indicia as necessary for commercially viable reuse or recycle programs.

U.S. Pat. No. 5,611,469 discloses a Hanger With Identification Clip having a through opening in the attachment web between the attachment rib and the childproof safety rib. However, once the indicator is mounted, the opening is covered and cannot be used to provide entry of an indicator detachment tool.

SUMMARY OF THE INVENTION

Accordingly, it is an object of the present invention to provide an improved garment hanger having an indicator detachment opening which allows an indicator to be attached to a hanger in one or more of the foregoing ways, but which permits removal of the indicator in an automated operation that reduces the likelihood of damage to the indicator or to the hanger.

The invention therefore provides a molded plastic hanger having a modified indicator attachment area or tab holder integrally formed as part of the hanger, with a ridge on the tab holder which surrounds the tab to prevent a consumer from obtaining a "finger purchase" on the tab to remove the tab. The modified tab holder includes at least one through opening in the web and ridge which enables an automated wedge tool to be inserted through the opening and engage the indicator on one side and a reaction surface on the other to remove the indicator from the hanger.

In another embodiment of the invention, the indicator attachment area includes a raised area for seating the indicia which prevents unauthorized or inadvertent removal, since the raised area causes a finger nail or other sliding tool to "jump" when it engages the raised portion. In this embodiment, the indicator attachment area includes a through opening which also extends through the raised area, and any locking ridges formed on the indicator attachment area. This opening enables an automated wedge tool to be inserted through the opening and engage the indicator on one side and a reaction surface on the other to remove the indicator from the hanger.

In use, as will be described more fully below, the indicator or side sizer is disengaged from the indicator attachment area by inserting a wedge through the opening or aperture to thereby release the indicator from the garment hanger.

The method and apparatus of the present invention provide an extremely versatile arrangement which can accommodate virtually all types of side sizer indicators mounted on a garment hanger. The method and system can also accommodate a wide variety of hanger and indicia types.

Accordingly, it is an object of the invention to provide a system which includes: a first means for securing the hanger for removal of the indicator; an automated actuating means for driving a wedge through an opening or aperture in the hanger; and means for collecting and disposing of the indicator.

In operation, the reciprocal wedge is actuated to engage the indicator and the reaction surface in the indicator attachment area to remove the indicator from the hanger while the hanger is secured by in a reference position.

The hangers with side sizer indicators affixed thereto can be lined up on a feeding rail which is slanted such that the force of gravity feeds the hanger into position against an automated means for manipulating and securing the hangers, as described in U.S. Ser. No. 08/908,210, entitled Indicator Detachment Mechanism And Method And Apparatus For Removing Indicator From Hangers, which application is assigned to the assignee of the present invention, the disclosure of which is incorporated herein by reference thereto.

The first means of the present embodiment may also include a milled out portion or template defining a recess substantially corresponding to the shape and dimensions of the hanger to be received such that when the hanger is received in the recess, the through opening is correctly positioned for the automatic wedge mechanism. When the indicator engages the recess of the first plate the indicator detachment mechanism is positioned to remove the size indicator from the hanger. Thus, the system of the present invention is easily adapted to accommodate a variety of hanger configurations.

To remove the indicator from the hanger the wedge is driven transversely to the first means by, for instance, a pneumatic cylinder means, while the hanger is resting in the recess of the first means.

The system further contemplates forceful ejection of the indicator from the hanger, which ejection may direct the indicator into a vacuum capture plenum.

A vacuum collection system can be attached to said vacuum capture plenum such that upon ejection, the indicator is removed from the detaching apparatus and collected in a separate device.

It is also an object of the present invention to provide a device for manually removing an indicator from a hanger with an indicator attachment mechanism. In a preferred embodiment the device includes a wedge tool for manual insertion into the through opening formed in the indicator attachment web of the hanger.

The device for manually removing the indicators from hangers can include a bench mounted wedge and a hanger guide mounted to a support such that the operator need not handle the device while manually removing the indicator from the hangers.

It is a further object of the present invention to provide a method for removing an indicator from a hanger by inserting a wedge mounted on a first means into the though opening in the hanger to displace the indicator from the indicator attachment area on the hanger. The method can be performed either manually or automatically.

The automated method for removing the indicator from the garment hanger comprises: holding a plurality of hangers with indicators affixed thereto; selectively engaging one of the hangers; securing the hanger; and inserting the displacement wedge into the opening in the indicator attachment area to remove the indicator from the hanger.

BRIEF DESCRIPTION OF THE DRAWINGS

The foregoing and other objects of the invention may now be more readily ascertained from the following detailed description of preferred embodiments thereof, taken in conjunction with the accompanying drawings; in which:

FIG. 1(*a*) illustrates a front elevation view of a portion of a hanger incorporating a side sizer locking attachment mechanism, and a modified form of the through opening of the present invention formed therein;

DETAILED DESCRIPTION OF THE PREFERRED EMBODIMENTS

In the preferred embodiment, the improved hanger of the present invention is formed of styrene which provides a clear virtually transparent hanger for maximum display of garments suspended therefrom. Alternately, the hanger could be formed from K resin, H.I. styrene, polypropylene or other suitable thermoplastic.

Figure 1:
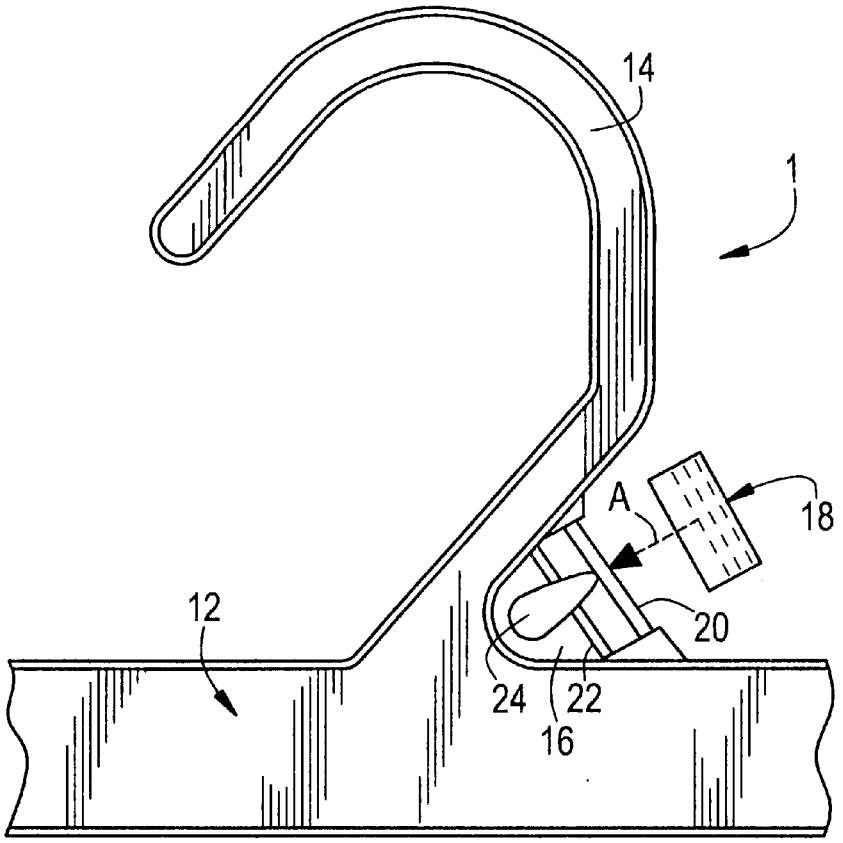
FIG. 1 illustrates a front elevation view of the hook of a hanger incorporating a typical side sizer locking attachment mechanism, and the through opening of the present invention formed therein.
Figure 1A:
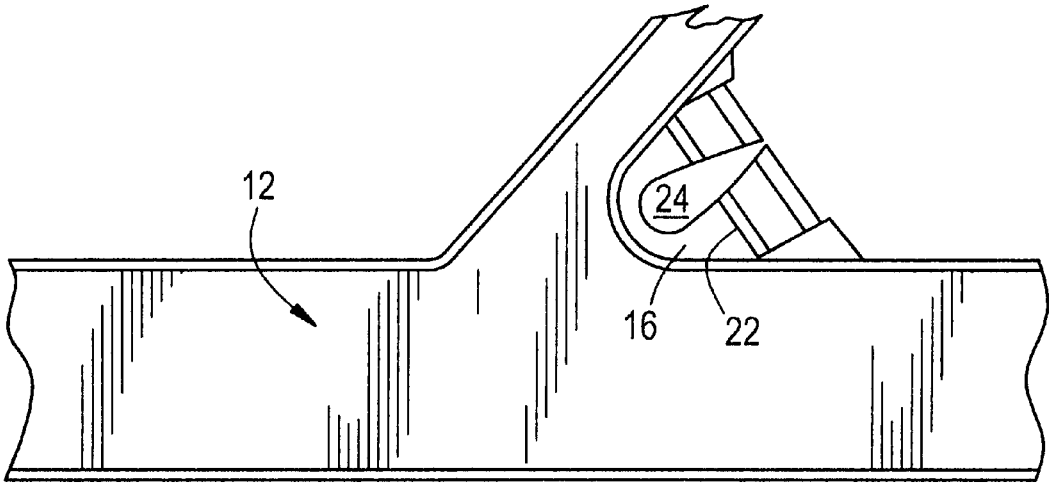

The hanger 1 illustrated in FIG. 1 is equipped with a hook 14 for engaging a rod or other supporting means, and a body 12 for supporting a garment to be hung on the hanger. A web 16 extends between the hook 14 and the body 12 to provide an indicator attachment mechanism to receive an indicator 18 which bears an indicia or color, or both, relating to a characteristic of the garment suspended from hanger body 12. As illustrated in FIG. 1, it is common for the indicator 18 to be attached to the web member 16 by snapping it downwardly over an attachment rib 20 in the direction of arrow A, illustrated in FIG. 1. The web also includes a second rib 22 which may be used to childproof the hanger and prevent easy removal of the indicator 18.

Environmental concerns on the part of large retail sales organizations have prompted a desire for hangers having side sizers 18 that are essentially unremovable for the average customer and, thus, "childproof" within the meaning of that term as described by the garment industry. The industry also desires that the side sizers be removable with the appropriate tooling for reuse and recycle purposes, but at present no automated apparatus is available for this removal. Inasmuch as the indicators are generally colored plastic, it is highly desirable in any recycling program to remove the indicator before grinding the hangers for reuse. If the program is a reuse program rather than a recycling program, it is necessary to remove the old size indicator before attaching a new one.

The present invention includes a hanger having a side sizer indicia tab wherein the tab is essentially unremovable for the average consumer, but removable with the indicator detachment mechanism of the present invention. To enable removal of the tab, at least one through opening 24 is formed in web 16 which extends through the web, and through the security rib 22 which prevents access or "finger purchase" on the edges of indicia 18. Alternately, the through opening may extend through both the attachment rib 20 and the security rib 22, or may extend to the attachment rib, with a cut through the attachment rib 20 as illustrated in the enlarged portion of FIG. 1 (a).

Figure 2:
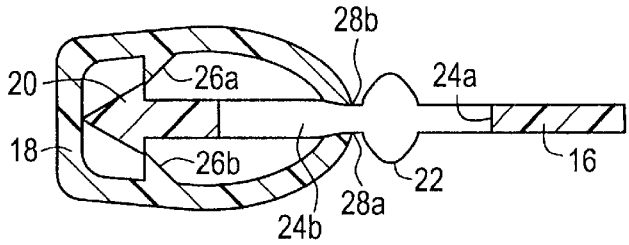
FIG. 2 illustrates an enlarged sectional view of a portion of the garment hanger and indicator of FIG. 1.

FIG. 2 illustrates in cross-section, web 16 of hanger 1 having a side sizer indicia 18 attached thereto. As illustrated in FIG. 2, the size indicia 18 includes a pair of inwardly extending barbs or ridges 26*a*, 26*b* which snap over the enlarged retention rib 20 of web 16. A variety of internal rib or barb constructions are known in the prior art and illustrated in the various patents referred to in the summary of the prior art above.

As illustrated in FIG. 1 and FIG. 2, a security rib 22 is also provided on web 16 to prevent the easy removal of the indicia by enabling "finger purchase" under one of the inwardly directed legs 28*a*, 28*b* of the size indicia 18.

Figure 3:
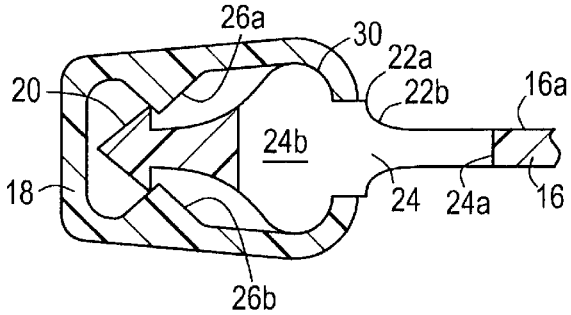
FIG. 3 illustrates an enlarged sectional view of a portion of a second type of garment hanger and side sizer indicator.

An alternate security arrangement is illustrated in 3, wherein the web 16 receives an indicator 18 in the matter illustrated by arrow A in FIG. 1. The web 16 of the hanger illustrated in FIG. 3 is formed somewhat differently in cross-section and uses an alternate means for thwarting the easy removal of the indicator 18. As illustrated in FIG. 1, the web 16 includes a first rib 20, which cooperates with internal barbs or ridges 26*a*, 26*b* to secure the indicator to the web 16. Web 16 also includes an enlarged rib 30 which stabilizes the indicator 18 to prevent undesirable movement of the indicator in normal use. The arrangement illustrated in FIG. 3 also includes a security land 22*a* which is elevated above the planar surface 16*a* of web 16. In practice, this elevated land 22*a* and the curved portion 22*b* cause a fingernail or other removal device to "jump" the gap between the indicator 18 and the land 22*a*, making it extremely difficult for the average consumer to remove the indicator 18.

The present invention uses a through opening 24 formed in web 16 to enable the removal of the "non-removable" indicators 18. The through opening 24 includes a reaction surface 24*a* and an opening which extends through the web and through the security rib 22 or the security land 22*a* to a space 24*b* underlying the indicator 18. The through opening may extend through both the attachment rib 20 and the security rib 22, or may extend to the attachment rib, with a cut through the attachment rib 20 as illustrated in the enlarged portion of FIG. 1 (a). The through opening should not be so large as to permit "finger purchase" on the underside of the indicator, and should be transverse to the indicator 18.

The removal of the "non-removable" indicator 18 will be described with respect to FIGS. 5 and 6 which illustrate in cross-section the web 16 of hanger 1, and the indicator 18 of FIG. 2 together with the removal tool of the present invention.

Figure 5:
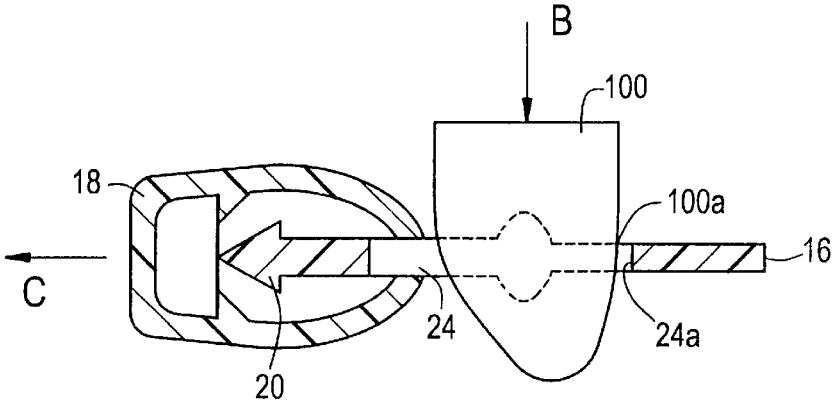
FIG. 5 is an illustrative view of the wedge and garment hanger with indicator just before detachment of the indicator.

As illustrated in FIG. 5, the indicator 18 is securely attached to web 16 by virtue of the retention rib 20 and internal barbs 26*a* and b which engage the retention rib 20. The open ends 28*a*, 28*b* are also supported on web 16 on either side of through opening 24.

To remove the side sizer indicator 18, a wedge tool is inserted into the through opening 24 between the reaction surface 24*a* and the inwardly extending legs 28*a*, 28*b*. As the wedge tool penetrates through the through opening 24, a first side of the wedge tool 100*a* engages the reaction surface 24*a* while the tapered removal edge 100*b* engages the inwardly extending arms 28*a* and 28*b* of the indicator 18. The downward motion indicated by the arrow B in FIG. 6 results in a laterally outward pressure in the direction of arrow C on the inwardly extending legs 28*a*, 28*b* causing the mid-portion of the indicator to bow outwardly, to a point where the barbs or ribs 26, 26*b* which are formed of plastic, will be resiliently deformed and slide over the retention rib 20 to the position illustrated in FIG. 5. The resilient quality of the plastic materials from which the indicators 18 are normally formed creates a sudden release of the indicator 18 from web 16, expelling the indicator 18 in the direction of arrow C. The rate of downward movement of the wedge tool 100 determines to some extent the forcefulness of the detachment of indicator 18 from web 16, and the detachment process can be regulated to some extent by varying the penetration rate of wedge tool 100 through the through opening 24. A thin blade type wedge tool may also be employed in combination with a through opening 24 which cuts through the attachment rib 20 to insure complete removal of the indicator in the event of multiple security ribs.

Figure 4:
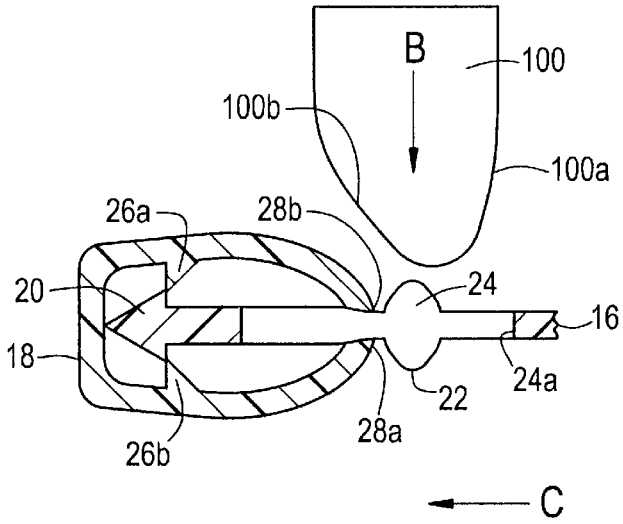
FIG. 4 illustrates a diagrammatic view of the first means for detaching apparatus an indicator in the detaching position.

The automated detachment of the indicator 18 from the hangers 1 will be described with respect to FIG. 6. As illustrated in FIG. 4, one or more hangers are suspended from an angled rod 105, which may gravity feed the hangers to the first means 107 for removal of the indicator. The first means 107 may reciprocate into a support position by virtue of a support and drive mechanism 133. A plurality of blocks 200, 202 and 204 may define a template for securing the hanger from undesirable movement, and in combination with angled rod 105, define a registration means for aligning the hanger with the automatic detachment wedge 100. Wedge tool 100 is mounted to the first means, which reciprocates wedge 100 through the through opening 24 defined in hanger 1. In a preferred embodiment, it is driven by a pneumatic cylinder or electric solenoid.

While sandwiched in this position, the wedge tool 100 is driven through the through opening 24 in hanger 1 in the manner previously described with respect to FIG. 3. Wedge tool 100 may be easily driven by a pneumatic cylinder attached to the back plate 107. Alternately, electromagnetic or hydraulic drive mechanisms may be utilized as desired. The penetration of wedge tool 100 results in the forcible detachment of the indicator 18 as illustrated in FIG. 6. The first means 107 may then be reciprocated out of engagement with the hanger 1 to provide for removal and/or reuse of the hanger.

Figure 6:
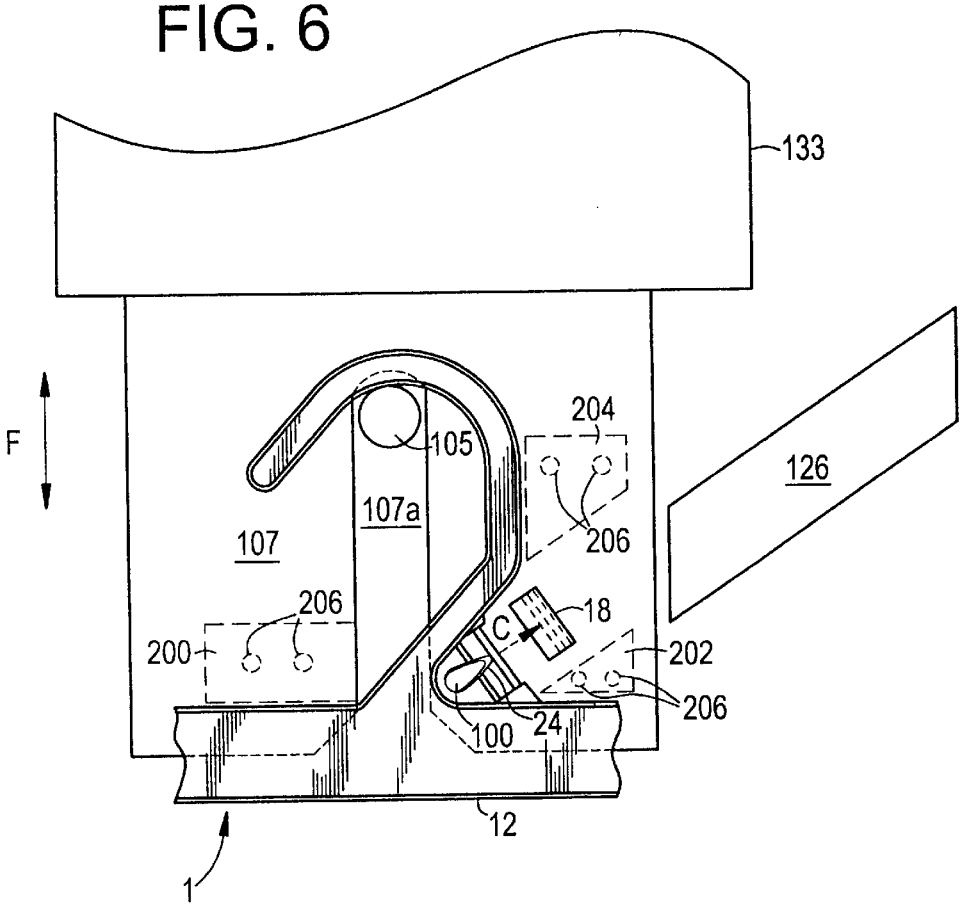
FIG. 6 is an illustrative view of the wedge and garment hanger with indicator at the moment of detachment of the indicator.

Thus, the detachment mechanism illustrated in FIG. 6 cycles repetitively to automatically detach a plurality of the "non-removable" indicators 18 from a plurality of hangers 1.

As illustrated in FIG. 6, the first means 107 includes a slot 107*a* to allow reciprocation of the means 107 about hanger rod 105. Alternately, first means 107 could be formed as a laterally reciprocating plate traversing the space between the support rod 105 and the hanger body 12, provided the wedge tool 100 is reciprocated to a position approximate that of through opening 24. While in the start of downward position illustrated in FIG. 6, the hanger 1 may be further aligned for processing by means of removable template blocks which are illustrated in dotted lines at 200, 202, and 204 in FIG. 7. These blocks may be secured to the back plate 107 by means of alignment pins or screws 206. The template blocks 200–204 enable a variety of hanger configurations and styles to be automatically processed by the apparatus of the present invention. Blocks 200–204 provide registration blocks for the hanger 1 that maintain the hanger in a proximate location for entry of wedge tool 100 through the through opening 24. Blocks 202 and 204 also define therebetween an exit window for the forcible expulsion of indicator 18 when the wedge tool 100 is driven through the through opening 24.

Alternatively, recesses may be milled into the first means 107 to provide a stabilizing template for the hanger 1 to be processed, and to provide an exit path for indicator 18.

A vacuum tube 126 may also be provided adjacent the exit path defined between blocks 202 and 204 to receive the indicator 18 and convey it to a collection bin for further processing or recycling.

Figure 7:
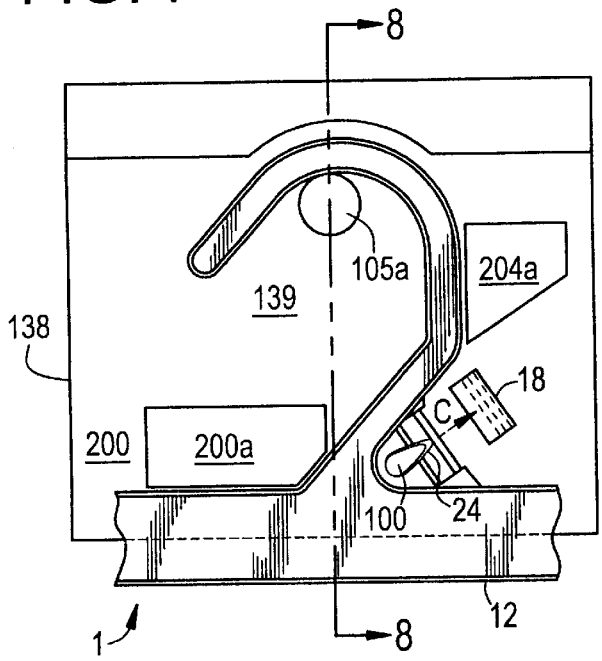
FIG. 7 is a plan view of one embodiment of a manual detachment mechanism constructed in accordance with the present invention.
Figure 8:
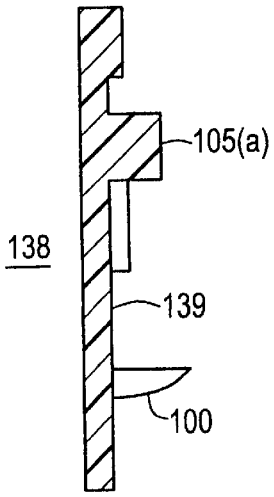
FIG. 8 is a cross-section view of the manual detachment apparatus illustrated in FIG. 7 taken along section lines 8–8' of FIG. 7.

Referring now to FIGS. 7 and 8, there is illustrated a tool for manually removing the indicators 18 from hanger 1. FIG. 7 illustrates a plan view of the manual removal tool, while FIG. 8 illustrates a section view taken along section line 8–8' of FIG. 7.

The device for manually removing an indicator from a garment hanger can be hand-held, or may have a rectangular shape as illustrated in FIGS. 7 and 8 for bench mounting. The device includes a plate 138 which can be made of metal or molded plastic and includes a recessed area 139 for receiving the hanger and a wedge tool 100 which extends upwardly from the recessed area 139 to engage the through opening 24 in the hanger having an indicator to be removed. The wedge tool 100 performs exactly the same function as previously described with respect to FIGS. 4–6. The only difference is that with the manual detachment mechanism, the hanger 1 is manually positioned with the wedge tool 100 entering the through opening 24, and then the hanger is pressed downwardly against the recess in plate 139 to effect removal of the indicator 18. An alignment pin 105*a* and alignment blocks 200*a* and 204*a* may be provided to assist the operator in aligning the hanger 1 to engage the wedge tool 100 in the through opening 24. As the hanger is pressed into engagement with the recessed area 139, the wedge tool 100 removes the indicator 18 in the direction of arrow C as illustrated in FIG. 7.

It is understood that although preferred embodiments of the present invention have been described and that various modifications may be made by one skilled in the art without departing from the scope of the invention is defined in the following claims. While the detachment apparatus of the described embodiment is pneumatically driven, the detachment apparatus could be driven by electrical, mechanical or other appropriate drive means.

Furthermore, the present invention has been described and illustrated in connection with a single type of side sizer indicator 18, although it is understood that the present invention can be used without adaption, or easily adapted to accommodate virtually any type of side sizing indicator.

While it has been shown and described what is considered to be the preferred embodiment of the invention, it will, of courses, be understood that various modifications and changes in form or detail can be readily made without departing from the spirit of the invention. It is, therefore, intended that the invention not be limited to the exact form and detail herein shown and described nor to anything less than the whole of the invention as hereinafter claimed.

What is claimed is:

1. A garment hanger adapted to have an information indicator mounted thereon, wherein said indicator has side walls, said indicator further defining at least one internal projection;

said garment hanger comprising a body having a hook member joined to said body at one end thereof, and a web adjacent said hook and said body for receiving said indicator, said web defining an engagement rib which cooperates with said internal projection to secure said indicator to said web, said web further having a security means to prevent outward movement of said side walls and disengagement of said projection and said engagement rib, said web defining at least one through opening, said opening extending through said security means so as to be partially covered by said indicator.

2. A garment hanger as claimed in claim 1 wherein said information indicator is a side sizer indicator which includes first and second side walls with at least one barb on each side wall, and said web includes at least one security rib which is engaged by said barbs.

3. A garment hanger as claimed in claim 1 wherein said information indicator is a side sizer indicator which includes first and second side walls wherein said at least one projection includes an engagement barb and a security barb on each side wall, and said web includes at least one security rib adjacent said engagement rib, which ribs are engaged by said barbs to secure said indicator to said hanger.

4. A garment hanger as claimed in claim 1 wherein said through opening extends through said security means and said engagement rib.

5. A garment hanger as claimed in claim 3 wherein said security means is a rib which prevents access to open edges defined by said sidewalls.

6. A garment hanger as claimed in claim 3 wherein said through opening extends through said security rib and said engagement rib.

7. A garment hanger as claimed in claim 1 wherein said security means is an elevated land which receives an open edge defined by said sidewall.

8. A garment hanger as claimed in claim 7 wherein said through opening extends through said elevated land to said engagement rib.

9. A garment hanger as claimed in claim 7 wherein said through opening extends through said elevated land and said engagement rib.

* * * * *